US010968573B2

(12) United States Patent
Szönyi

(10) Patent No.: US 10,968,573 B2
(45) Date of Patent: Apr. 6, 2021

(54) FALL PROTECTING FLOORING ELEMENT PRIMARILY FOR COVERING PLAYGROUNDS AND FLOORING COMPOSED THEREFROM

(71) Applicant: Nándor Szönyi, Komárno (SK)

(72) Inventor: Nándor Szönyi, Komárno (SK)

( * ) Notice: Subject to any disclaimer, the term of this patent is extended or adjusted under 35 U.S.C. 154(b) by 0 days.

(21) Appl. No.: 16/610,004

(22) PCT Filed: Dec. 5, 2018

(86) PCT No.: PCT/HU2018/050051
§ 371 (c)(1),
(2) Date: Oct. 31, 2019

(87) PCT Pub. No.: WO2020/002956
PCT Pub. Date: Jan. 2, 2020

(65) Prior Publication Data

US 2020/0385935 A1 Dec. 10, 2020

(30) Foreign Application Priority Data

Jun. 26, 2018 (HU) ..... P1800225

(51) Int. Cl.
*E01C 13/04* (2006.01)
*E04F 15/02* (2006.01)

(52) U.S. Cl.
CPC ..... *E01C 13/045* (2013.01); *E04F 15/02005* (2013.01); *E04F 15/02183* (2013.01);
(Continued)

(58) Field of Classification Search
CPC .... A63H 33/00; A63H 33/086; A63H 33/088; A63H 33/08; A63H 33/04; A63H 33/082;
(Continued)

(56) References Cited

U.S. PATENT DOCUMENTS 5,052,158 A 10/1991 D'Luzansky
5,215,490 A * 6/1993 Szoradi ..... A63H 33/08 446/115

(Continued)

FOREIGN PATENT DOCUMENTS

EM 002459248-0001 5/2014
EP 2019169 B1 2/2017
WO 2017202486 A1 11/2017

OTHER PUBLICATIONS

International Search Report for PCT/HU2018/050051 and English Translation submitted herewith, dated May 17, 2019 (4 pages).

(Continued)

*Primary Examiner* — Kien T Nguyen
(74) *Attorney, Agent, or Firm* — Fitch, Even, Tabin & Flannery, LLP

(57) ABSTRACT

Fall protecting flooring element that comprises a flat rectangular body of a resilient Material having a lower face, an upper face, four sides, patterns at its four sides that enable interlocking several similar flooring elements by form-fitting connections. Respective short straight corner sections are provided that constitute a part of the side of the concerned side. The patterns comprise alternating sequence of connection tabs and connection recesses. The connection tabs have identical profiles but inverse of the profiles of the connection recesses. A plurality of fall protecting floor elements can be connected together to form a flooring.

17 Claims, 4 Drawing Sheets

(52) U.S. Cl.
CPC ..... *E01C 2201/12* (2013.01); *E01C 2201/14* (2013.01); *E04F 2201/0146* (2013.01); *E04F 2201/091* (2013.01); *E04F 2201/095* (2013.01)

(58) Field of Classification Search
CPC ..... A63B 2208/12; E04B 1/54; E04B 1/6104; E04B 2/18; E04B 2/20; E04F 13/045
USPC ..... 446/120–123, 125–128, 108, 111; 52/245, 249; 472/90–94
See application file for complete search history.

(56) References Cited

U.S. PATENT DOCUMENTS

| | | | | |
|---|---|---|---|---|
| 5,950,378 | A | 9/1999 | Council et al. | |
| 6,142,848 | A * | 11/2000 | Madner | A63H 33/04 446/107 |
| 6,526,705 | B1 | 3/2003 | MacDonald | |
| 9,522,342 | B2 * | 12/2016 | Jazouli | A63H 33/086 |
| 2011/0120037 | A1 | 5/2011 | Barlow | |
| 2013/0178130 | A1 * | 7/2013 | Balint | A63H 33/084 446/120 |

OTHER PUBLICATIONS

Written Opinion of the International Searching Authority, dated May 17, 2019 (7 pages).

* cited by examiner

Fig. 9
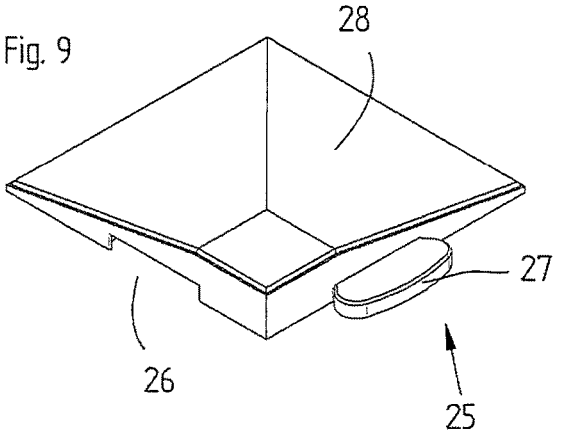
Fig. 10
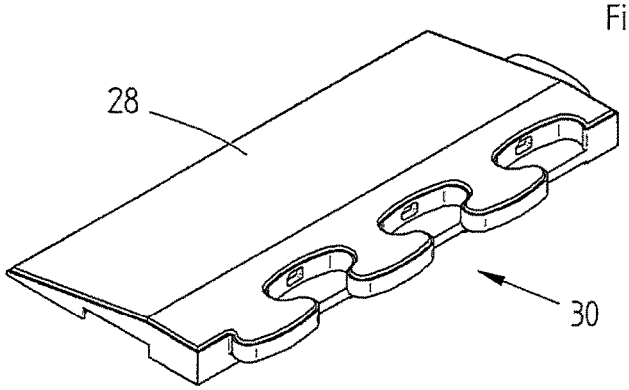
Fig. 7
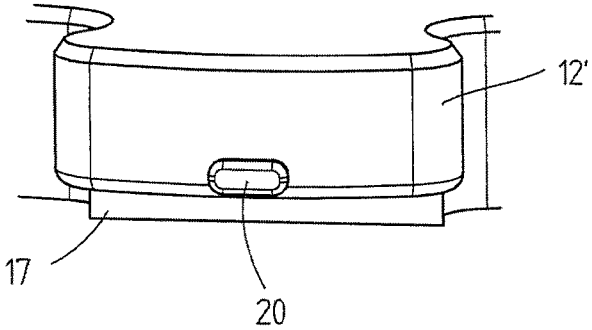
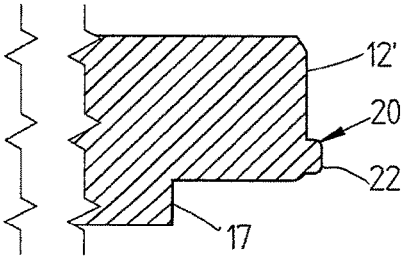
Fig. 7.a
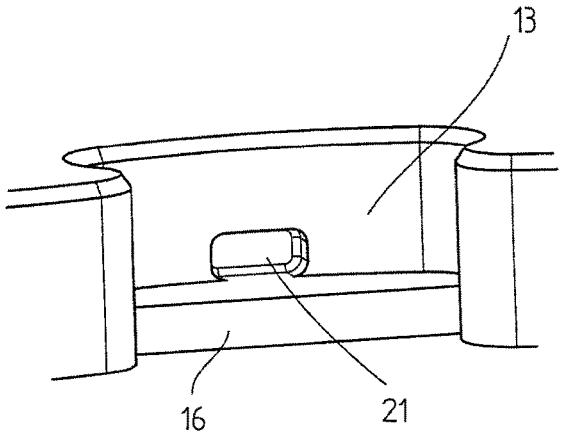
Fig. 8

FALL PROTECTING FLOORING ELEMENT PRIMARILY FOR COVERING PLAYGROUNDS AND FLOORING COMPOSED THEREFROM

CROSS-REFERENCE TO RELATED APPLICATIONS

This application is a U.S. national phase application filed under 35 U.S.C. § 371 of International Application No. PCT/HU2018/050051, filed Dec. 5, 2018, designating the United States, which claims priority from Hungarian Patent Application No. P180225, filed Jun. 26, 2018, the complete disclosures of all the applications are hereby incorporated herein by reference in their entirety.

The invention relates to a fall protecting flooring element primarily for covering playgrounds and other grounds that has a flat rectangular body made of a resilient material, the body is continuously covered or in one or both sides it has depressions or opening arranged in a grid, and the design of its four sides enable interlocking several similar flooring elements by form-fitting connections, at the four corners of the body respective short straight corner sections are provided that constitute a part of the side of the concerned side, the patterns comprise alternating sequence of connection tabs and connection recesses, wherein the profile of the connection tabs are identical but inverse of the profile of the connection recesses, and at the base of the flooring element for the support of connection tabs provided on a different flooring element to be interconnected therewith a support surface is provided.

Such flooring elements are described and shown in US 2011/0120037 A1 in which from the flat square body of the basic flooring element triangular connection tabs are extending out which narrow in outward direction and having ends cut parallel to the concerned side of the body, and in predetermined lateral distance therefrom similar open triangular recesses are formed. In the region of the connection tabs and recesses the element has a decreased thickness, and the full thickness is obtained after adjacent flooring elements are fitted in the recesses.

In this solution when the adjacent flooring elements are fitted into each other, there will be no such a form fitting connection provided that could prevent the separation of the elements in lateral direction, therefore from the bottom of the connection tabs respective bolts extend out and in the support plates of the connection recesses openings are provided to received the bolts, and when the elements are interlocked, the bolts are inserted in the openings. In case the ground under the flooring elements is not exactly planar, then nothing will prevent the adjacent flooring elements to follow the curved shape of the ground, and the connection tabs will extend out of the connection recesses.

U.S. Pat. No. 6,526,705 describes quadratic flooring elements, in which at respective pairs of adjacent sides a pattern is provided that facilitates the interconnection of the elements. These patterns form the mirror shape of each other and take their widest portion at the outer (or inner) edges, which means that the interlocking of these patterns automatically prevents the disengagement of the elements in lateral direction. The pattern is made also in such a way that it takes only a part of the thickness of the element and only the combined thickness of a pair of the fitted inverted patterns make the full thickness of the material. For the sake of appropriate interconnection in one of the side-pairs respective outer ridges are provided and in the other one of the pair grooves receive the ridges and the interconnection of the ridges and the grooves strengthen the interconnection of the flooring elements. Two out of the four sides of the flooring element are straight and have a length higher than the widest outer side of the connection tabs, and at the two other sides the edges are formed by the outer contour line of the pattern. In order to provide a continuous flooring from such flooring elements special designs should be provided at the corner zones which imposes limits to the simply interconnectivity of the flooring elements because they cannot be fitted at any of their sides. The adjacent flooring elements are not protected by any solution against displacements normal to their base plane, and this property renders the use of such flooring element difficult or even impossible if the ground is undulate i.e. non-planar.

In the document EP 2019169 B1 a quadratic flooring element is shown that is composed of square grids constituted by mutually normal rows and columns, and at the edges of the flooring element the end regions of the columns and rows are provided with mutually fitting cuts and projections. By a regular arrangement of such flooring elements any size of surface can be covered.

The Community Design 002459248-001 shows a grid like flooring element that has hexagonal openings arranged in a honeycomb structure, wherein the hexagonal patterns are partially extending over the sides and the corresponding edges are provided with appropriate cuts that enable fitting of the elements to each other.

The last listed two flooring elements can be used to provide floors or ground covers of any size by interlocking the corresponding sides of the flooring elements.

When the aforementioned known flooring elements are used for making floors, it is a true requirement that the ground underneath be tooled to become fully planar. In case of men made flooring this condition can be easily fulfilled, whereas in case of open air uses the accurate ground work I connected with substantial costs. When floor elements having grids are used rain can pass through the openings, and during use under the effect of any uneven load or of humidity the ground that has differing solidity at different sites can get deformed and smaller or larger swellings or recesses can be formed. For an initial period the grid bars of the flooring elements are substantially strong to preserve the initial plane, but more serious ground deformations an angular difference can be formed between the planes of adjacent flooring elements, and as a result the mutually fitted connection parts can open up and gaps, deformations may be formed that negatively influence the aesthetic impression of the flooring and the gaps can always be sources of potential accidents.

Beside the aforementioned main problem it is also less preferred that the indented appearance of the outer edges of the flooring elements at the sides of the flooring owing to the outwardly extending connection profiles is not pleasing and lends an unfinished temporary impression for the flooring.

The task of the invention is to provide a fall protecting flooring element wherein the interlocking of the identical flooring elements can be carried out in simple and stable way so that the interconnected flooring elements cannot move away from each other and the flooring made thereby does not require the preparation of a strictly planar ground underneath.

A further task of the invention is to provide connection means for the flooring element wherein the disassembly of previously fitted and set flooring elements requires a special skill and probable special tools.

A still further task of the invention is the suitable coverage of the sides of the previously set and fitted flooring elements which can cover the indentation of the edges of the flooring that would otherwise have a non-aesthetic appearance.

For solving these tasks a fall protecting flooring element has been provided primarily for covering playgrounds and other grounds that has a flat rectangular body made of a resilient material, has a lower and an upper face and the design of its four sides enable interlocking several similar flooring elements by form-fitting connections, at the four corners of the body respective short straight corner sections are provided that constitute a part of the side of the concerned side, the patterns comprise alternating sequence of connection tabs and connection recesses, wherein the profile of the connection tabs are identical but inverse of the profile of the connection recesses, and at the base of the flooring element for the support of connection tabs provided on a different flooring element to be interconnected therewith a support surface is provided and according to the invention the sides starting at a corner at one end of a diagonal of the rectangular body are provided with the same first pattern that have identical connection tabs and identical connection recesses, and the other sides starting at corner at the other end of the same diagonal also have an identical second pattern that differs from said first pattern, and the second pattern also comprises identical connection tabs and identical connection recesses that have designs differing from the design of the connection tabs (12) and connection recesses (13) in the first pattern, and the connection tabs and the connection recesses have widths that all take their maximum values at a central part of their height from which maximum the width decreases both in outward and inward direction, and in the first pattern at the bottom of the connection recesses respective plates are provided which form integral part of the body and having a thickness smaller than the thickness of the body, the plates constitute said support surface and the front edges of the plates extend till a straight line interconnecting said corner sections on the associated side, and the connection tabs in said second pattern have a thickness smaller than the thickness of the body which is just by the thickness of the plates in the first pattern thinner than the thickness of the body, and the straight line interconnecting the corner sections falls in the central part of the concerned pattern.

For the sake of good interconnection it is preferred when in the first pattern the thickness of the connection tabs is the same as the thickness of the body, and in the second pattern the height of the connection recesses is the same as the thickness of the body.

For a strong interconnection of the flooring elements it is preferred if in the lower central part of the connection tabs which are thinner than the body, respective noses are provided which slightly extend out from the associated connection tab in forward direction, and in the lower rear surface of the connection recesses which are provided with said plates a respective depression is provided having dimensions corresponding to that of the nose to receive the nose present on the connection tab which is to be inserted in the concerned connection recess.

The introduction of the nose will be facilitated in case the nose has an inclined front face that gets narrower in downward direction.

In accordance with local requirements inner cavities open from below can be provided in the inner portion of said body.

It is also preferred if between two corner sections on the sides provided with identical patterns the distance corresponds to an even number multiple of the width of the connection tabs and connection recesses when the distance is measured along the straight line interconnecting the corner sections.

It is also preferred if the connection tabs and connection recesses have respective curved profiles.

The invention relates to flooring made by such flooring elements.

The flooring comprises preferably straight edge closure elements for closing the respective sides thereof, and at one side of the edge closure elements there is a first or second pattern which fits to the pattern on the side which is covered thereby.

For closing the corner regions the flooring comprises preferably corner elements which are connectable to the respective sides of the edge closure elements located just at the corners of the respective sides of the flooring and comprise at their lateral sides a connection tab and at the other side a connection recess.

It is advantageous if said corner element and/or said edge closure element has an outwardly descending inclined surface.

At the bottom of the flooring elements downwardly extending ribs are provided that improve the placement on the ground and increase the rigidity of the flooring element, and the ribs extend preferably parallel to the sides of the flooring element.

The flooring element according to the invention will now be described in connection with exemplary embodiments thereof wherein, reference will be made to the accompanying drawings. In the drawing:

FIG. 7 shows an enlarged perspective view of a positive connection tab;

FIG. 7*a* shows an enlarged detail of FIG. 7;

FIG. 8 shows the enlarged perspective view of a connection recess;

FIG. 9 shows the perspective view of a corner element;

FIG. 10 shows the perspective view of a straight closure element; and

Figure 11:
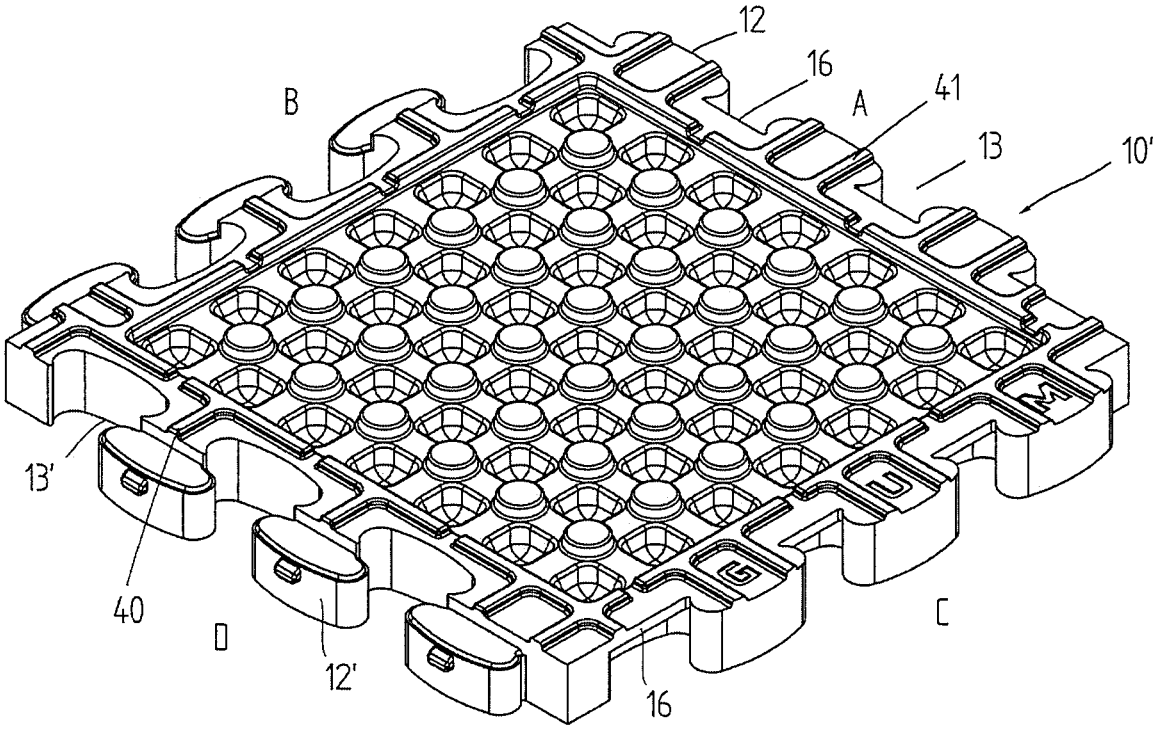

FIG. 11 shows the perspective view of an embodiment of the flooring element having a reinforced bottom when viewed from below.

Figure 1:
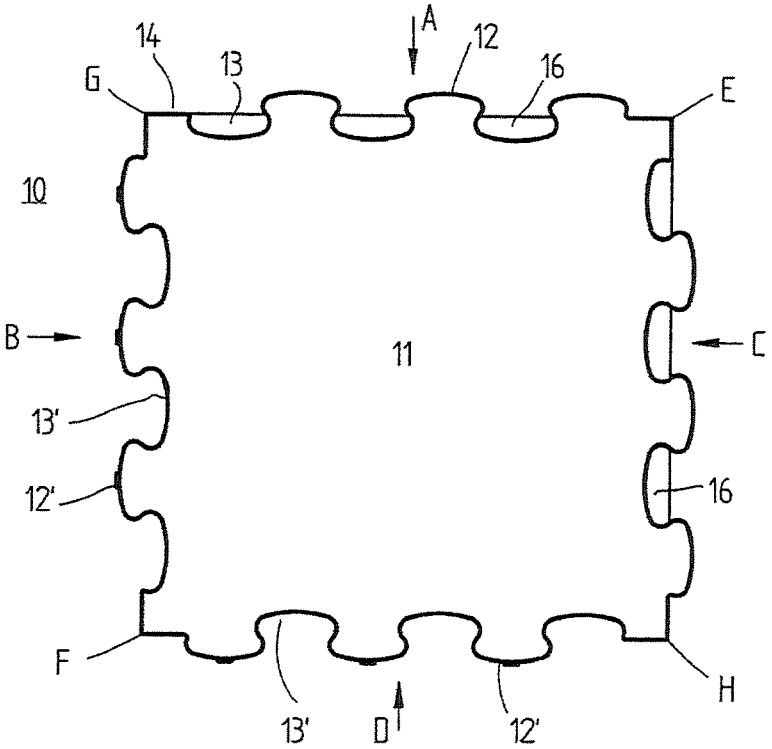
FIG. 1 is the top view of a flooring element.
Figure 4:
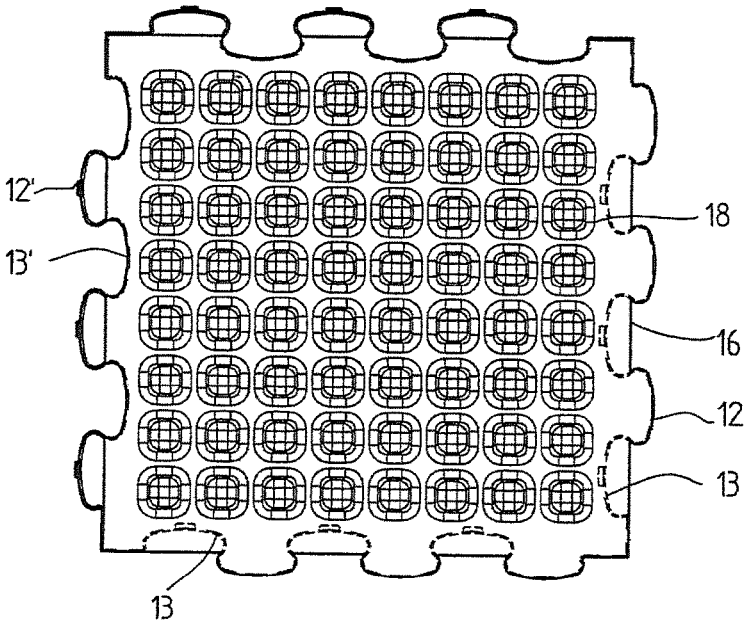
FIG. 4 is the bottom view of the flooring element.

The top view of FIG. 1 shows flooring element 10 that has a flat square body with sides A, B, C and D having shapes resembling to special curved lines used in "jigsaw puzzle" toys. The design of the patterns of the sides A and C is similar to each other, and in the following this will be referred to as "first pattern". The pattern of the sides B and D are also similar to each other which will be referred to as "second pattern" which differs from the first pattern. The sides A and C meet each other at corner E of the square shape and the sides B and D meet each other at corner F which is arranged diagonally opposite to the corner E. FIG. 1 shows upper surface 11 of the flooring element 10 which is a continuous planar surface in this embodiment.

At the edges of each side connection tabs 12 or 12' and connection recesses 13 or 13' are provided which have respective curved profiles that continue each other, and their shape and design resemble to those of well known jigsaw puzzles, and the shape also resembles to the half of a figure-of-eight curve. Characteristic to this shape is that the width of the connection tabs 12 and 12' is always changing and it takes its maximum in a central section and from here it decreases towards both directions. The shape of the connection recesses 13 and 13' is the inverse of the connection tabs 12 and 12', therefore each connection tab 12 and 12' can be inserted and fitted in the connection recess 13 and 13' of another flooring element. Owing to the changing width of the shapes form-fitting connections are established which prevent the disassembly of the so interconnected flooring elements by pulling in lateral direction. At each of the corners E, F, G and H the edges start with respective straight corner sections 14, and following the respective corner sections 14 the alternating sequence of connection tabs 12 or 12' and connection recesses 13 or 13' is provided which terminates in the short straight corner section 14 on the other end of the same side. At the corner regions of each of the sides the short corner sections 14 falls in the same line, and this imaginary line separates the connections tabs 12 or 12' from the connection recesses 13 or 13' which constitute their continuations. Under such a design an arrangement should be understood in which from the same interconnection line of the two corner sections 14 on the same side the connection tabs 12 or 12' extend out in normal direction to the same extent as the depth of the connection recesses 13 or 13' extend in the other direction. This means if a flooring element 10 is interconnected with another flooring element in such a way that the side A or C of the first flooring element should be connected to the side B or D of the other flooring element, then the connection tabs 12 or 12' can be exactly fitted into the connection recesses 13' or 13 of the other flooring element, and the theoretical separation line between the two flooring elements falls in the line interconnecting the corner sections 14. If from each of the corners we move in clockwise direction, then the straight corner sections 14 are always followed by a connection recess 13 or 13'. The length of the sides of the flooring element 10 or the identical width of the connection tabs 12 or 12' and the connection recesses 13' or 13 are chosen in such a way that the distance between the inner ends of the corner sections 14 on the same side should be the even numbered multiple of the width of the connection tabs 12 or 12' and of the same width of the connection recesses 13' and 13, and from this law it follows if the pattern on a side starts with a connection recess 13 or 13' then it will terminate with a connection tab 12 or 12'—Such a design is at the same time the condition if the interconnection of a plurality of flooring elements 10 is required then into the respective connection recesses 13 or 13' always a connection tab 12' or 12 on a corresponding side of the opposite flooring element side will be fitted. This also means that if in a side the pattern starts with a connection recess 13 or 13' then the same side will terminate with a connection tab 12' or 12.

Figure 2:
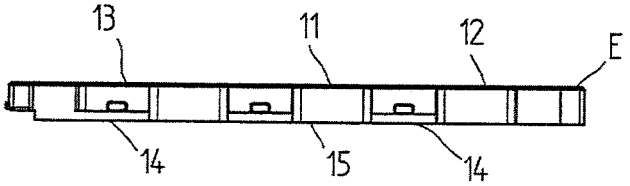
FIG. 2 is the view of the flooring element projected from the direction a side A.
Figure 5:
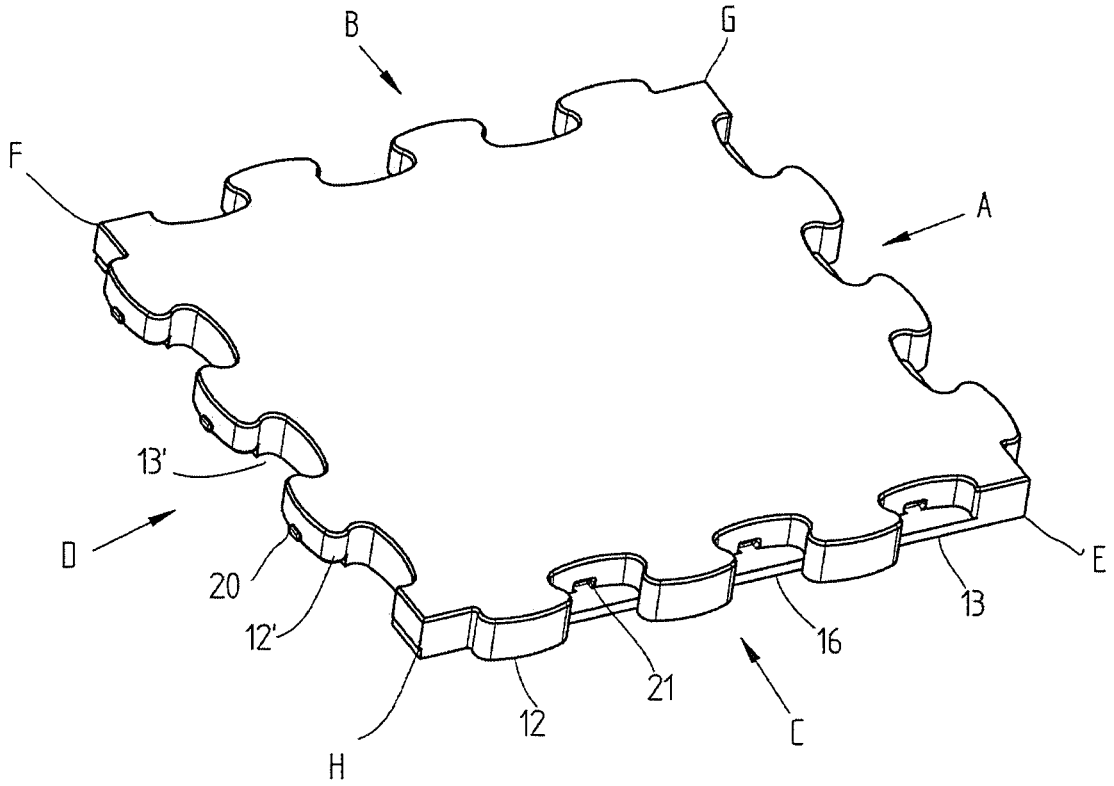
FIG. 5 is the perspective view of an embodiment of the flooring element from an oblique view from above.

In FIG. 1 and in the view of FIG. 2 it can be seen that at the side A and at the neighbouring side C the bottom of all connection recesses 13 are covered by respective thin plates 16 that extend till the outer ends of these connection recesses 13 i.e. till the virtual straight line interconnecting said short straight corner sections, and the plates 16 have bottom surfaces falling in the plane of lower surface 15 of the flooring element 10. The plates 16 can well be seen also on the perspective views of FIGS. 5 and 8. The plates 16 form the bottom of all connection recesses 13, therefore the bottom of the connection recesses 13 lies just by the thickness of the plates 16 higher than the bottom surface 15 of the flooring element 10. The plates 16 have a small thickness e.g. 0.1 to 0.3 part of the thickness of the flooring element 10 and in any case smaller than its half thickness.

Figure 3:
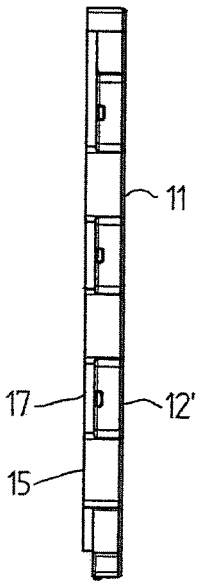
FIG. 3 show the side view of the flooring element projected from the direction of side B.
Figure 6:
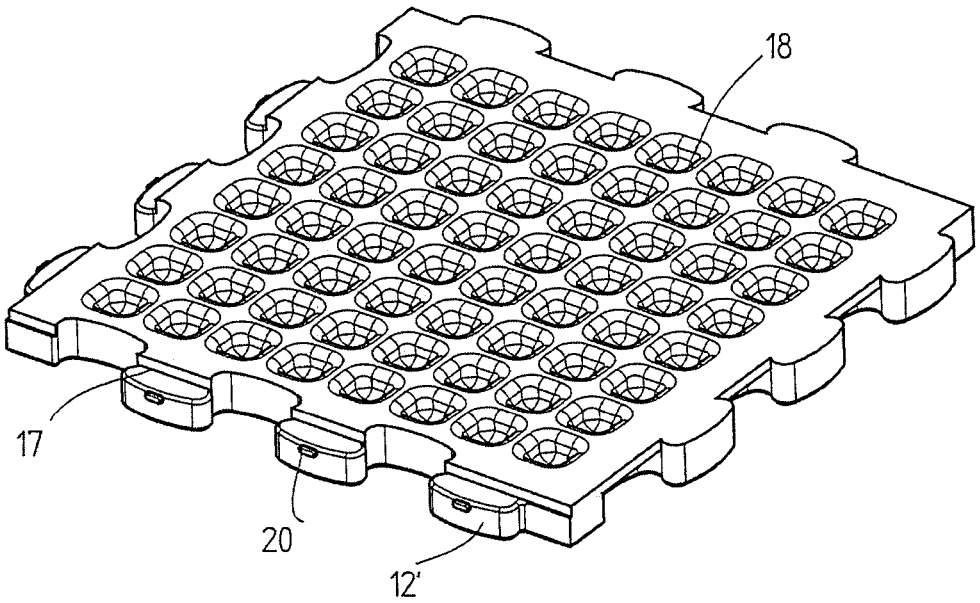
FIG. 6 is the perspective view of the embodiment of FIG. 5 projected obliquely from below.

In order that the presence of the plates 16 cannot disturb the placement of the otherwise identical but inversely shaped connection tabs 12' into the respective connection recesses 13, the bottom plane of the connection tabs 12' at the sides B and D extends only till the upper plane of the plates 16 which means that the thickness of the connection tabs 12' is just by the thickness of the plates 16 smaller than the full thickness of the flooring element 10. In the bottom of the connection tabs 12' edges 17 are formed which can be seen in FIG. 3 and in the perspective views of FIGS. 6 and 7. The bottom of the connection recesses 13' provided in the sides B and D is not covered by the plates 16, and in correspondence therewith the thickness of the connection tabs 12 provided at the sides A and C is the same as the full thickness of the flooring element 10, therefore its thickness is different from the thickness of the connection tabs 12'.

A specific feature of such a design lies in if a plurality of identically designed flooring elements 10 can be interconnected in such a way that the side A or C of a flooring element should be placed and snapped to the side B or D of another flooring element from above, i.e. to a side provided with the first pattern I connected to another side provided with the second pattern, whereby the connection tabs 12' of the upper flooring element will be fitted in the connection recesses 13 of the oppositely located flooring elements. Owing to the presence of the plates 16 and to the smaller thickness of the connection tabs 12' that are supported by the plates 16, the lower surfaces 15 of the interconnected flooring elements will lie in the same plane without the formation of any breaking line. The thickness of the connection tabs 12 provided at the sides A and C can be the same as the full thickness of the flooring element 10, and at the sides B and D the connection recesses 13' need not be provided with the plates 16, as their thickness is also the same as the thickness of the body of the flooring element. Such a design, i.e. the presence of the plates 16 stabilizes the position of the mutually fitted flooring elements in the direction normal to the main planes thereof, i.e. if the surface of the ground is slightly curved and deviates from the geometric plane, then the presence of the plates 16 does not allow the opening of the interconnected flooring elements 10 in a direction normal to the plane of the ground. This property is advantageous at several types of use.

It has been mentioned that from the point of view of interlocking the flooring elements 10 apart from the above described patterns provided at the side regions the design of the internal part of the flooring elements 10 has no significance. In the exemplary embodiment the flooring element 10 had a planar upper surface 11 but it has a lower face 16 that comprises cavities 18 open from below and arranged in rows and columns. The presence of the cavities 18 decreases in the first hand the weight of the flooring element 10 and on the other hand it facilitates support on the ground, and in case of a looser soil if the flooring element 10 slightly gets sunken in the soil it makes possible that the soil parts moved away from the sunken areas can take place in the empty volumes of the cavities 18. This possibility stabilizes the position of the flooring element 10 on such grounds. In the exemplary embodiment the cavities 18 are designed as squares with rounded corner regions but any other shape can be used for forming the cavities. In case the continuous upper surface 11 is not a requirement by the intended use, then instead of the cavities 18 with closed tops, through going openings can be provided. Such flooring element can be used e.g. for covering lawns, in which grass can grow and extend through the openings, and rain water can also be lead away thereby.

In many applications the flooring elements 10 should be interlocked so that thereafter the connection remains stable and the flooring elements cannot move away from each other even if the ground will slightly move underneath and the continuous interconnection of the flooring elements cannot be disturbed by the displacement of the flooring elements or if their respective planes gets slightly inclined. The most significant drawback of conventional flooring elements and patterns set by jigsaw puzzles lies in that they are capable of being separated i.e. they can keep their upper plane only if the supporting ground underneath has an overall planar shape.

The design of the flooring element 10 described in the foregoing has a substantial position stabilizing effect just because of the presence of the plates 16 and the connection tabs 12' supported by the plates 16. A further embodiment is shown in FIGS. 5 to 8 that ensures an increased fitted interlocking of the interconnected flooring elements 10 and prevents disengagement of the fitted adjacent elements (e.g. because of possible angular differences in the planes of their respective supports) or prevents the formation of cracks along the connection lines of their upper surfaces. Reference is made now to the enlarged view of FIG. 7 that shows the enlarged perspective view of a connection tab 12'. At the bottom of the central front side thereof a small nose 20 extends out in frontal direction which has a rectangular cross section when viewed from the front side. In a position corresponding to that of the nose 20 in the inner wall of the connection recess 13, above the plate 16 a rectangular depression 21 is provided with a size that fits to the size of the nose 20 so that the nose 20 can be introduced into the depression 21. The presence of the noses 20 and of the depressions 21 can also be observed in the perspective views of FIGS. 5 and 6. The interconnection of the flooring elements 10 is facilitated if the nose 20 comprises a downwardly narrowing inclined front face 22 which can be seen on the enlarged sectional view of FIG. 7*a*. When the flooring elements are interconnected the connection tabs 12' should be positioned into the oppositely located connection recesses 13 by exercising a small pressure from above. Because of the resilient and slightly deformable material of the flooring elements 10, under the effect of the pressing force the connection tabs 12' will get slightly contracted. This contraction makes it possible that in spite of the presence of the nose 20 that has a size slightly exceeding the depth of the connection recess 13 that the connection tab 12' can slide in the associated connection recess 13 from above, and when the nose 20 gets into an opposite position with the depression 21, than the resilient force of the material will push the nose 20 into the depression 21, and thereafter this interconnected position will be retained in a long lasting way.

It should be noted that on the connection tabs 12 and connection recesses 13' there is no need to provide the noses 20 or the depressions 21 because the thickness of these elements is the same as the thickness of the flooring elements 10.

Reference is made now to FIGS. 9 and 10 which show preferable embodiments of closing elements that cover the edge patterns of the flooring made by the flooring elements. The appearance and aesthetic value of the interconnected flooring elements is negatively affected by the presence of the patterns visible at the edge regions. The use of the flooring elements 10 will be facilitated if corner elements 25 shown in FIG. 9 are attached to the corners of the flooring and straight edge closure elements 30 shown in FIG. 10 are attached to the sides of the flooring. The corner element 25 has a square shape and has two connectable sides of which one comprises a connection recess 26 and the other one comprises a connection tab 27. In case of thicker flooring elements it can be preferred if the upper plane of the corner element 25 has an outwardly and downwardly inclined oblique surface 28 along which the thickness decreases in outward direction. In FIG. 8 two of such oblique surfaces 28 can be seen. The use of such oblique surfaces 28 is of course optional and corner elements 25 with constant thickness can also be used.

The straight edge elements 30 shown in FIG. 10 are used to close the straight sides of the flooring made by the flooring elements 10 and they are provided with one or the other type of patterns to fit to the pattern on the side to which it will be connected. In one type the connection tabs are provided with respective noses 20 and connection recesses covered by the plates 16 and having depressions 21, and in the other type the thickness of the connection tabs and recesses is the same as the thickness of the material and there is no need of using any nose 20 or depression 21. Out of the two versions one should select the type which has a fitting pattern with the side to which the edge element will be connected. The corner element 25 should be placed to the empty area formed between the respective ends of the straight edge closure elements 30, whereby the surface formed by these edge closure elements 30 will be continued. The outwardly declined oblique surface 28 can be provided also on the corner elements as it can be observed in FIG. 10.

The flooring element 10 according to the invention can be made with different design from the exemplary embodiment shown as long as the interlocking of the flooring elements 10 is provided by the fitting and conforming profiles of the connection tabs and the connection recesses and in which the bottom of certain connection recesses is covered by a thing plate which has a higher upper plane as the bottom of the flooring element supported by the ground and the corresponding connection tabs are supported by these plates and these tabs are correspondingly thinner than the thickness of the element.

FIG. 11 shows the perspective view projected from the bottom of a reinforced flooring element 10'. The difference from the previously shown embodiment lies in that the bottom 15 of the flooring element 10' is not precisely planar and from it ribs 40 and 41 swell out from the surface that extend in parallel to the sides of the flooring element 10'. The ribs 40, 41 has the purpose of reinforcing the flooring element 10' and to stabilize the placement in case of softer grounds as they provide a more definite support.

The flooring element according to the invention and the flooring made thereby is preferred in the first place for open air use, but it can well be used also for interior floorings, especially because its excellent fall protection properties. It should be noted that in the examples only square flooring elements 10 were shown, but the interconnectivity can be provided even if the flooring element is rectangular and the length of the longer side is the integer multiple of the length of the shorter side. If the full coverage of the ground is not an objective, then it can be sufficient if one side of a flooring element (e.g. its side A or C) and the other side (e.g side B or D) of a different flooring element to be fitted thereto be designed in a mutually fitting way as explained earlier.

The invention claimed is:

1. A fall protecting flooring element primarily for covering playgrounds and other grounds, wherein the fall protecting flooring element comprises a flat rectangular body having four sides (A, B, C and D) and four corners (E, F, G and H), wherein the flat rectangular body comprises a base, a lower face, an upper face, and a support surface, the flat rectangular body comprised of a resilient material, the four sides (A, B, C and D) having patterns that enable interlocking several similar flooring elements by form-fitting connections, respective short straight corner sections are provided at the four corners (E, F, G, H) of the flat rectangular body that constitute a part of the side of the concerned side, the patterns comprise alternating sequence of connection tabs having a profile and connection recesses having a profile, wherein the profile of the connection tabs is identical but is the inverse of the profile of the connection recesses, and the support surface is at the base of the flooring element for the support of connection tabs provided on a different flooring element to be interconnected therewith, wherein the sides (A, C) starting from a corner (E) at one end of a diagonal of the body of the flooring element are provided with the same first pattern that have identical connection tabs and identical connection recesses, and the sides (B, D) starting from the corner (F) at the other end of the same diagonal also have an identical second pattern that differs from the first pattern, and the second pattern also comprises identical connection tabs and identical connection recesses that have designs differing from the design of the connection tabs and connection recesses in the first pattern, and the connection tabs and the connection recesses have widths measured along the concerned side that all take their maximum values at a central part of their height interpreted normal to the width in the plane of said upper face from which maximum the width decreases in both outward and inward directions, and respective plates are provided in the first pattern at the bottom of the connection recesses which form an integral part of the body and have a thickness measured normal to said upper face smaller than the thickness of the body, the plates constitute the support surface and the front edges of the plates extend till a straight line interconnecting the corner sections on the associated side, and the connection tabs in the second pattern have a thickness smaller than the thickness of the body which is just by the thickness of the plates in the first pattern thinner than the thickness of the body, and the straight line interconnecting the corner sections falls in the central part of the concerned pattern.

2. The flooring element as claimed in claim 1, wherein in the first pattern the thickness of the connection tabs is the same as the thickness of the body, and in the second pattern the height of the connection recesses is the same as the thickness of the body.

3. The flooring element as claimed in claim 1, wherein the flooring element further comprises a lower central part in the connection tabs, the lower central part of the connection tabs are thinner than the body, respective noses in the lower central part of the connection tabs wherein the noses slightly extends outwardly from the associated connection tab in forward direction, the connection recesses having a lower rear surface, and in the lower rear surface of the connection recesses which are provided with said plates a respective depression is provided having dimensions corresponding to that of the nose to receive the nose present on the connection tab which is configured to be inserted in the concerned connection recess.

4. The flooring element as claimed in claim 3, wherein the nose has an inclined front face that gets narrower in downward direction.

5. The flooring element as claimed in claim 1, wherein the flat rectangular body has an inner portion and inner cavities open from below are provided in the inner portion of the flat rectangular body.

6. The flooring element as claimed in claim 1, wherein all of the connection tabs and connection recesses have respective curved boundary lines.

7. The flooring element as claimed in claim 1, wherein the distance between two corner sections on the sides (A, C respectively B, D), which sides are provided with respective identical patterns, corresponds to an even number multiple of the width of the connection tabs and connection recesses when the distance is measured along the straight line interconnecting the corner sections of a respective side.

8. A flooring constituted by a plurality of the flooring elements as claimed in claim 1 that are interlocked by the mutual interlocking of the sides provided with the first and second patterns, and by fitting the connection tabs into the opposite connection recesses.

9. The flooring as claimed in claim 8, wherein the flooring further comprises straight edge closure elements for closing the sides thereof, and at one side the edge closure elements comprises a first or a second pattern that fits to the pattern of the side which is to be closed thereby.

10. The flooring as claimed in claim 9, wherein the flooring further comprises corner regions and corner elements for closing corner regions of the flooring, the corner elements are connectable to the sides of the straight edge closure elements at the corner region, the corner elements having two connectable sides, and on the two connectable sides of the corner elements a connection tab and a connection recess are provided.

11. The flooring as claimed in claim 10, wherein the corner element and/or the edge closure element has an outwardly descending inclined surface.

12. The flooring element as claimed in claim 1, wherein the flooring element further comprises outwardly and downwardly extending ribs on the bottom thereof for improving placement on the ground and increasing the rigidity of the flooring element.

13. The flooring element as claimed in claim 12, wherein the ribs extend in parallel to the sides of the flooring element.

14. A flooring constituted by a plurality of the flooring elements as claimed in claim 12 that are interlocked by the mutual interlocking of the sides provided with the first and second patterns, and by fitting the connection tabs into the opposite connection recesses.

15. The flooring as claimed in claim 12, wherein the flooring further comprises straight edge closure elements for closing the sides thereof, and at one side the edge closure elements comprises a first or a second pattern that fits to the pattern of the side which is to be closed thereby.

16. The flooring as claimed in claim 15, wherein the flooring further comprises corner regions and corner elements for closing corner regions of the flooring, the corner elements are connectable to the sides of the straight edge closure elements at the corner region, the corner elements having two connectable sides, and on the two connectable sides of the corner elements a connection tab and a connection recess are provided.

17. The flooring as claimed in claim 16, wherein the corner element and/or the edge closure element has an outwardly descending inclined surface.

* * * * *